US007333750B2

(12) United States Patent
Moore et al.

(10) Patent No.: US 7,333,750 B2
(45) Date of Patent: Feb. 19, 2008

(54) METHOD AND APPARATUS FOR REASSEMBLING A TONER CARTRIDGE

(75) Inventors: Darin L. Moore, Morrisville, NC (US); Erick T. Colbert, Apex, NC (US); James H. Jones, Fayetteville, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 11/335,427

(22) Filed: Jan. 19, 2006

(65) Prior Publication Data

US 2006/0120753 A1 Jun. 8, 2006

Related U.S. Application Data

(63) Continuation of application No. 10/676,514, filed on Oct. 1, 2003, now Pat. No. 7,013,100, which is a continuation-in-part of application No. 10/439,432, filed on May 16, 2003, now Pat. No. 6,801,734.

(51) Int. Cl.
*G03G 15/00* (2006.01)

(52) U.S. Cl. ..... 399/109; 399/111

(58) Field of Classification Search ..... 399/90, 399/107, 109, 110, 111
See application file for complete search history.

(56) References Cited

U.S. PATENT DOCUMENTS 2,435,876 A 2/1948 de Stewart
2,643,839 A 6/1953 Sislik
2,805,597 A 9/1957 O'Shaughnessy, Jr.
3,221,572 A 12/1965 Swick
3,373,789 A 3/1968 Parkin et al.
3,505,922 A 4/1970 Tinnerman
4,074,888 A 2/1978 Garner
4,770,583 A 9/1988 Lindberg
4,923,347 A 5/1990 Moryl et al.
4,997,327 A 3/1991 Cira
5,632,584 A 5/1997 Acevedo
5,729,795 A 3/1998 Kavolius et al.
6,099,190 A 8/2000 Honobe et al.
6,209,996 B1 4/2001 Gasvoda et al.
6,318,941 B1 11/2001 Guenther
6,406,233 B1 6/2002 Shaner
6,610,079 B1 8/2003 Li et al.
7,110,693 B1 * 9/2006 Michlin et al. ..... 399/90

* cited by examiner

*Primary Examiner*—Hoan Tran

(57) ABSTRACT

Techniques for remanufacturing a toner cartridge include providing the toner cartridge including an end plate secured to an end of the toner cartridge, removing the end plate from the toner cartridge, attaching an anchoring fixture to the end of the toner cartridge, and securing the end plate to the anchoring fixture of the toner cartridge.

6 Claims, 11 Drawing Sheets

METHOD AND APPARATUS FOR REASSEMBLING A TONER CARTRIDGE

The present application is a continuation of allowed U.S. patent application Ser. No. 10/676,514 filed Oct. 1, 2003, now U.S. Pat. No. 7,013,100, which is in turn a continuation-in-part of Ser. No. 10/439,432, filed May 16, 2003, now U.S. Pat. No. 6,801,734, both of which are incorporated by reference herein in their entirety.

Many imaging devices such as copiers, laser printers, and facsimile machines use toner cartridges. The toner cartridge contains many of the moving parts of the machine and contains a finite supply of toner. The original equipment manufacturers (OEM) intended for the consumer to use the toner cartridge until the initial toner supply is exhausted, and then replace it with a new laser toner cartridge. By placing many of the moving parts in the toner cartridge and making the toner cartridge disposable, the OEM reduced the amount of repair work required on the printers, copiers, or facsimile machines.

The used toner cartridge has many components that may be recycled. An industry known as the remanufacturing industry has arisen to take advantage of this fact. Remanufacturers take used toner cartridges, clean them, repair damaged components, replace worn out components, add new toner, and reintroduce these refurbished cartridges into the marketplace.

In the original manufacturing process, the OEM takes a toner hopper reservoir, seals it, and then ultrasonically welds it to a developer roller housing, creating a combined unit, the toner hopper assembly. The toner hopper assembly is further combined with a waste bin assembly as well as two endplates, which are attached to both ends of the cartridge, to create a fully assembled toner cartridge.

In the remanufacturing assembly process, the remanufacturers must first disassemble the cartridge before they can refurbish the cartridge. The disassembly process is in reverse order of the assembly procedure. Access to the various subcomponents can only be accomplished by tearing the cartridge down to its basic parts. By separating the toner hopper reservoir from the developer roller housing, remanufacturers duplicate the condition the cartridge was in when it was new. In the remanufacturing process, after remanufacturers place a seal over the toner hopper discharge opening, they reattach the toner hopper reservoir to the developer roller housing, and continue on with the complete reassembly of the toner cartridge.

When a remanufacturer reassembles the toner cartridge, the original fastening methods may not be efficiently reapplied. For example, where there may have been an ultrasonic weld during the original OEM assembly, the weld location may not have enough material left to be welded. In addition, in order to reinitiate an ultrasonic weld at a specific location, the cartridge might have to be disassembled further thus making the reassembly process more difficult and less efficient. Welding, gluing or other permanent joining also makes disassembly for remanufacturing on the next cycle more difficult.

The present invention illustrates a method of removably securing the various pieces of a toner cartridge without sacrificing stability, repeatability, and efficiency. By securing the endplate to the toner hopper reservoir using the present invention, the endplate may more easily be removed and reattached. This allows future recycling to be performed with much less effort as the various sections may be separated relatively easily. The securing anchor will provide a "quick connect" or a "quick disconnect."

Another advantage of the preferred embodiment is that it allows various attaching methods to be applied to the securing anchor. With this in mind, the preferred embodiment of the present invention will need to be mounted securely enough to be able to support screws that will be inserted through the endplate and attached to the apparatus. These screws will hold the endplate in place on the toner hopper reservoir. The present invention will be substantially rigid, insuring that the waste bin assembly and toner hopper reservoir will maintain proper alignment and stiffness via the endplate. The preferred embodiment of the present invention in conjunction with the endplate will provide added rigidity to the toner hopper reservoir and waste bin assembly once they are mated together. An example of a toner cartridge that can employ the present invention is the HP4200 toner cartridge manufactured by Hewlett-Packard.

SUMMARY OF INVENTION

A method for remanufacturing a toner cartridge include providing the toner cartridge comprising an end plate secured to an end of the toner cartridge, removing the end plate from the toner cartridge, attaching an anchoring fixture to the end of the toner cartridge, and securing the end plate to the anchoring fixture of the toner cartridge.

BRIEF DESCRIPTION OF THE DRAWINGS

This invention is explained below in detail referring to the accompanying drawing.

DETAILED DESCRIPTION

Figure 1A:
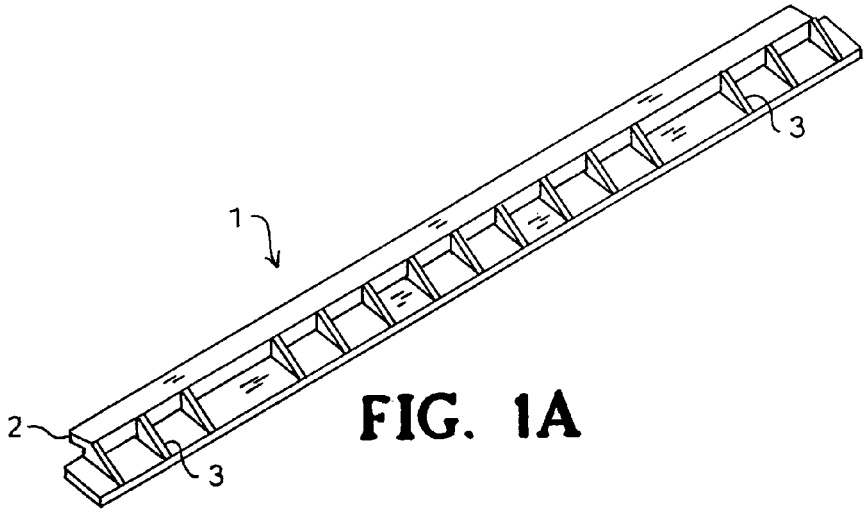
FIG. 1A is a front perspective view of the securing fixture.
Figure 1B:
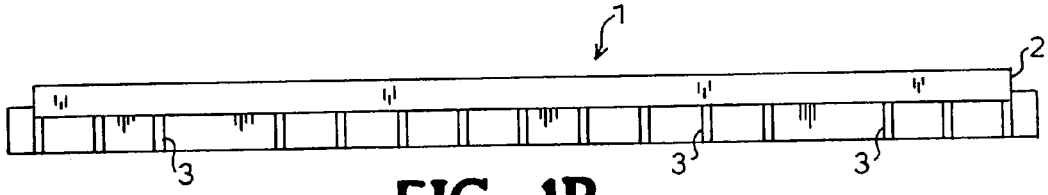
FIG. 1B is a top view of the securing fixture.
Figure 1C:
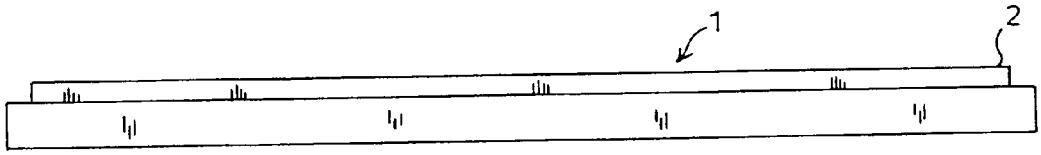
FIG. 1C is a bottom view of the securing fixture.

An example of a securing fixture is illustrated in FIGS. 1A, 1B and 1C. FIG. 1A is a front perspective view of the securing fixture 1. The securing fixture 1 comprises a lip 2 and ribs 3. The securing fixture 1 can be made of plastic. The securing fixture 1 may also be made of aluminum, steel or other types of metals, or other stiff materials. The main requirement would be that the securing fixture 1 be strong enough to absorb an upward force being applied by horizontal foam units 18 (FIG. 4.) through a forward securing edge 7 of a developer roller housing 6 (FIG. 2B) against the lip 2. The securing fixture must be rigid enough not to flex once this pressure is applied. If using another type of securing device such as a spring or other flexible material, this device may initially flex when the two pieces are mated together and could possibly flex during the life of the cartridge.

The securing fixture 1 may contain ribs 3, which will help provide support for the lip 2. The ribs 3 are pointed out in FIG. 1A and FIG. 1B. These ribs 3 will keep the lip 2 from bending backwards by distributing the load being applied by the horizontal foam units 18. Preferably, the ribs 3 will extend the entire length of the securing fixture 1, but they may be as simple as a single rib or as complex as a lattice of ribs.

The bottom of the securing fixture 1 as shown in FIG. 1C may be smooth or possibly textured, as long as it provides a sufficient surface area to be attached to the toner reservoir. The main requirement is that it be large enough to provide enough adhesion area. In the preferred embodiment, double-sided tape may be used. If gluing, both the bottom of the fixture and the area where it will be mounted may be grooved in order to allow the glue additional surfaces to bond to.

Figure 2A:
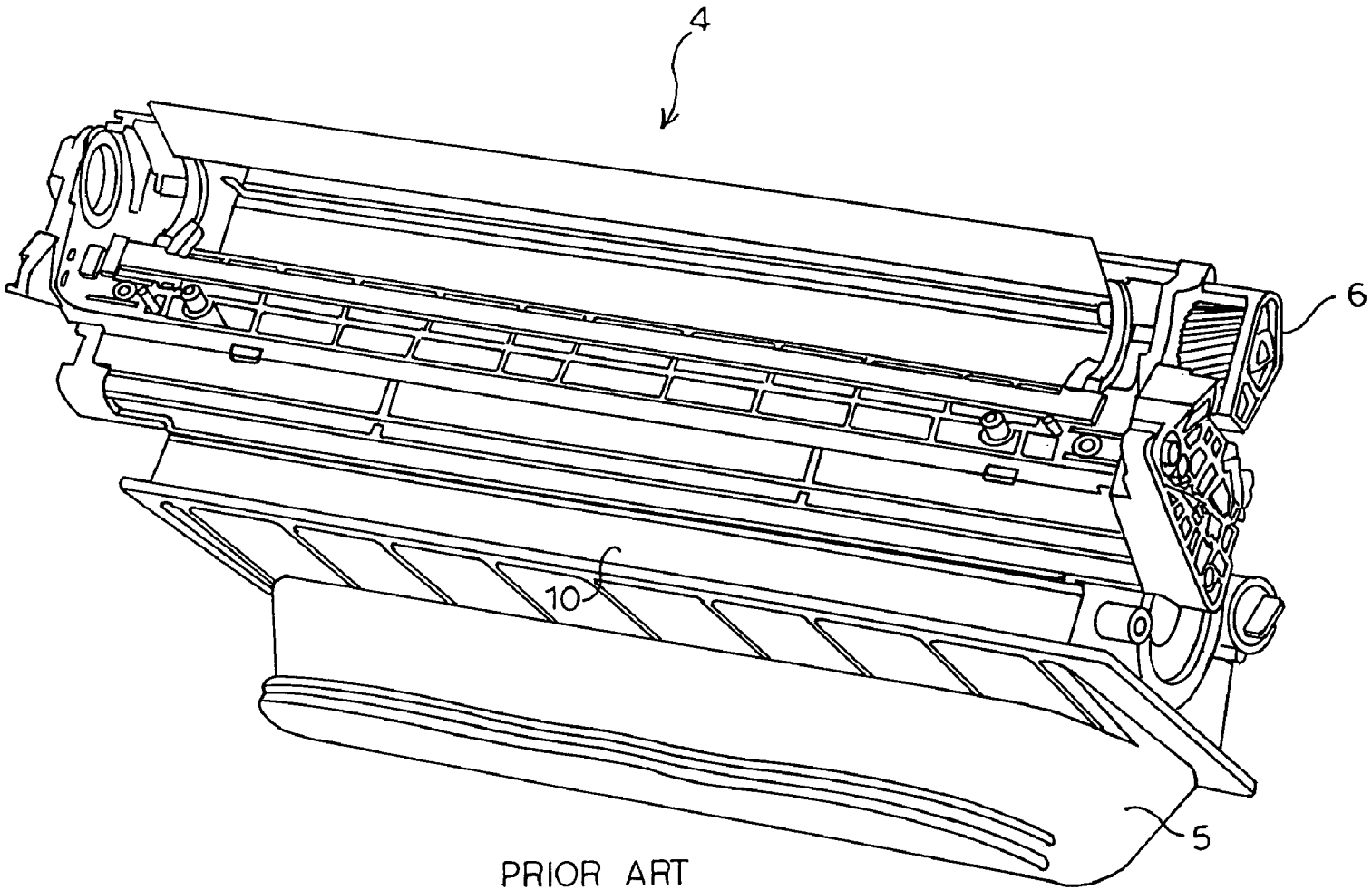
PRIOR ART FIG. 2A
FIG. 2A is a front perspective view of the HP4200 Toner Cartridge (Prior Art).

The securing fixture will fit within the boundary defined as an upper horizontal mounting area 10 on the toner hopper reservoir as shown in the prior art in FIGS. 2A&B. On the HP4200 toner hopper reservoir 5, this area is easily identified because it has raised edges, which define the outline of the upper horizontal mounting area 10. As well, the securing fixture 1 may be a single device that extends the entire length equal to that of the forward securing edge 7. An alternative would be to have two or more securing fixtures of varying lengths and sizes as long as the securing fixture(s) fit within the particular securing area.

The length and size of the lip 2 will be determined by the relative force being applied by the forward securing edge 7 as well as the amount of free space available between the developer roller housing and the toner reservoir. The longer the lip 2 extends from the base of the securing fixture 1, the more torque will be applied to the fulcrum or back of the securing fixture 1, and in turn may affect the adhesive or other method of attaching the securing fixture 1 to the toner hopper reservoir 5. As well, the lip 2 may not extend too far as it will interfere with the developer roller housing as it mates up with the toner hopper reservoir. In the preferred embodiment of a securing fixture, the lip will extend the full length of the securing fixture 1.

The method of attaching the securing fixture 1 to the toner hopper reservoir 5 may also vary. As previously discussed, the securing fixture may be secured by using a very strong double-sided tape. The tape would need to be strong enough to withstand the upward force being encountered by the lip 2 but not permanent in case the securing fixture 1 itself may need to be replaced. Other alternatives would be to attach the securing fixture with glue or possibly melting it into place. The disadvantage of gluing or melting the securing fixture 1 into place would be that replacing the securing fixture 1 at a later point in time would have to break this adhesive bond and if glued, the separation process could possibly damage the cartridge. Instead of using the securing fixture, ultrasonic welding may also be employed to secure the toner hopper reservoir 5 to the developer roller housing 6, but this process may not be cost effective for a remanufacturer.

An alternative may be to use a leaf spring to hold the developer roller housing 6 in place. The leaf spring would not be rigid per se, but could flex enough to add the extra force necessary to keep the joint secure. The leaf spring could be mounted on the upper horizontal mounting surface 10, so that it would make contact with the forward securing edge 7 of the developer roller housing 6. It is possible that the leaf spring, once mounted on the upper horizontal mounting surface 10, may actually touch the weld joint 11 prior to the mating of the developer roller housing 6 to the toner hopper assembly 4. Thus the forward securing edge 7 of the developer roller housing 6 would displace the spring as it was inserted.

FIG. 2A also shows some of the individual parts of an HP4200 toner hopper assembly 4. The toner hopper assembly 4 consists of a developer roller housing 6 and a toner hopper reservoir 5. FIG. 2A also shows an upper horizontal mounting surface 10, where the securing fixture 1 might be placed. The disassembling of the toner hopper assembly 4 will be covered in greater detail in subsequent sections of this specification.

Figure 2B:
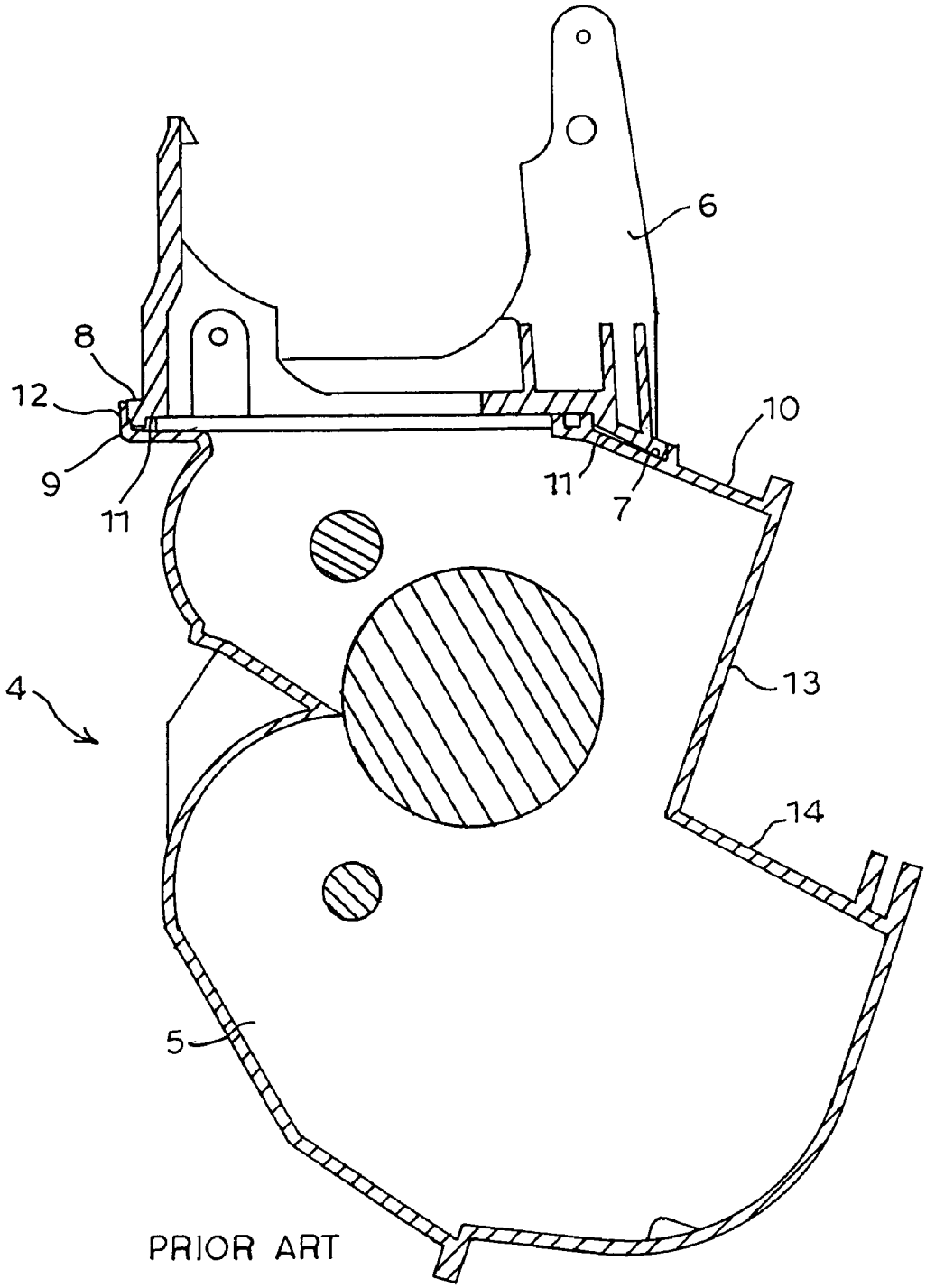
FIG. 2B is a cross sectional view of the HP4200 Toner Cartridge (Prior Art).

FIG. 2B is a cross sectional drawing of the same toner hopper assembly 4. From this drawing it is clear to see how the present invention is necessary to easily reassemble the toner hopper assembly 4 without having to glue or weld the developer roller housing 6 to the toner hopper reservoir 5. In this figure, it is easier to identify the forward securing edge 7 of the developer roller housing 6, which is ultrasonically welded to the toner hopper reservoir 5 in the original OEM assembly. This weld joint 11 is what keeps this side of the toner hopper assembly from separating. There is a corresponding weld joint 11 on the other side of the cartridge. The weld joint 11 on the rear portion of the toner housing assembly 4 is in between the upper rear securing flange 8 of the developer roller housing 6 and a lower rear securing flange 9 which is part of the toner hopper reservoir 5. The combination of the upper rear securing flange 8 and the lower rear-securing flange 9 create a combined rear-securing flange 12. When separating the developer roller housing 6 from the toner hopper reservoir 5, these weld joints 11 must be severed.

The toner hopper reservoir 5 additionally comprises various other mounting surfaces for the securing fixture 1. In the preferred embodiment, it is on an upper horizontal mounting surface 10 that the securing fixture 1 will be attached. A different securing fixture 1 might be designed to attach to a vertical mounting surface 13 or a second horizontal mounting surface 14. The shape of the securing fixture 1 will have to be adjusted accordingly to be able to fit along the contour of the toner hopper reservoir 5 and still provide some type of means to secure the developer roller housing. A securing fixture might also be designed to use the bottom of the toner hopper reservoir 5, which has a raised edge, as a securing location.

Figure 3A:
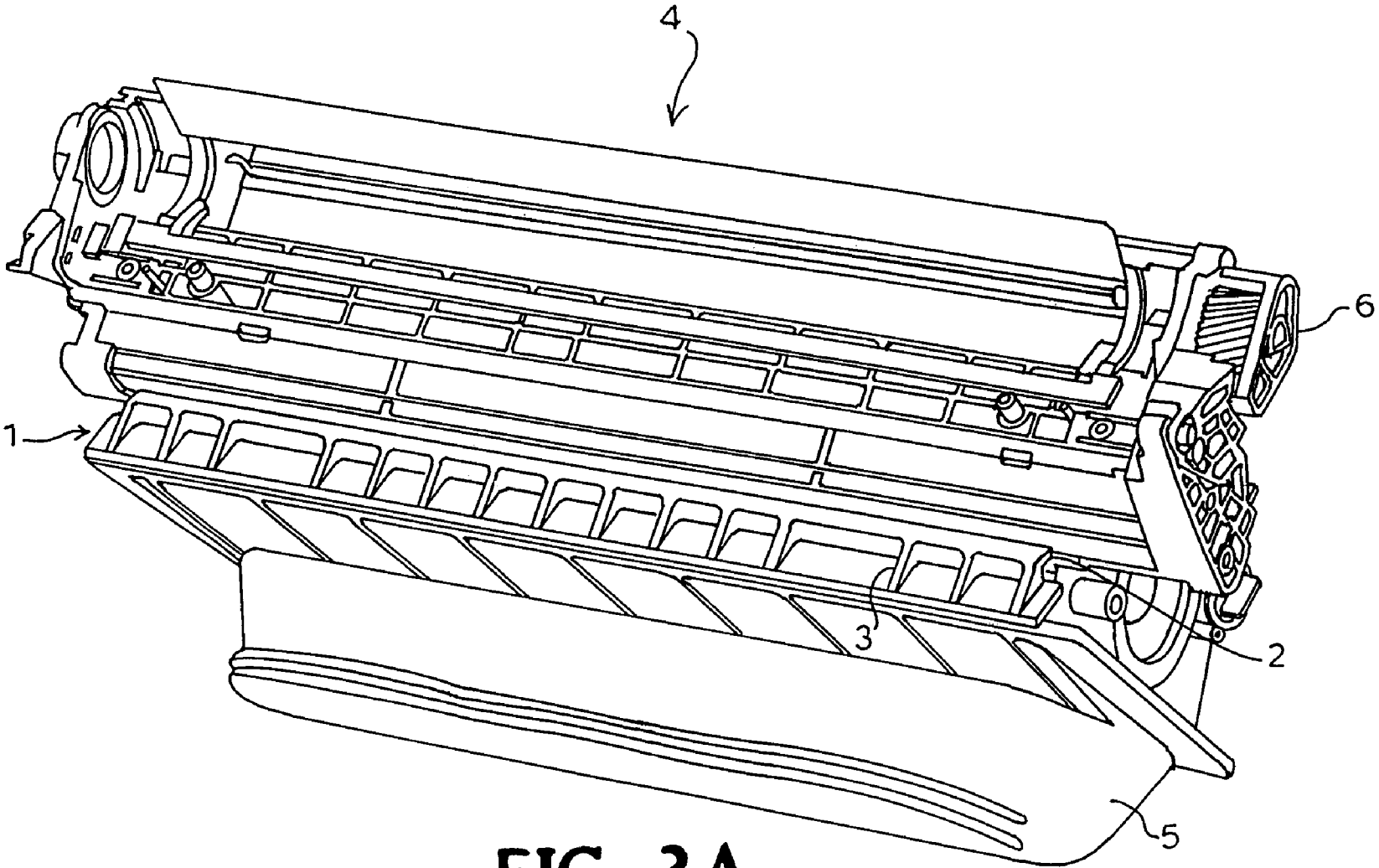
FIG. 3A is a front perspective view of the HP4200 Toner Cartridge with securing fixture attached.
Figure 3B:
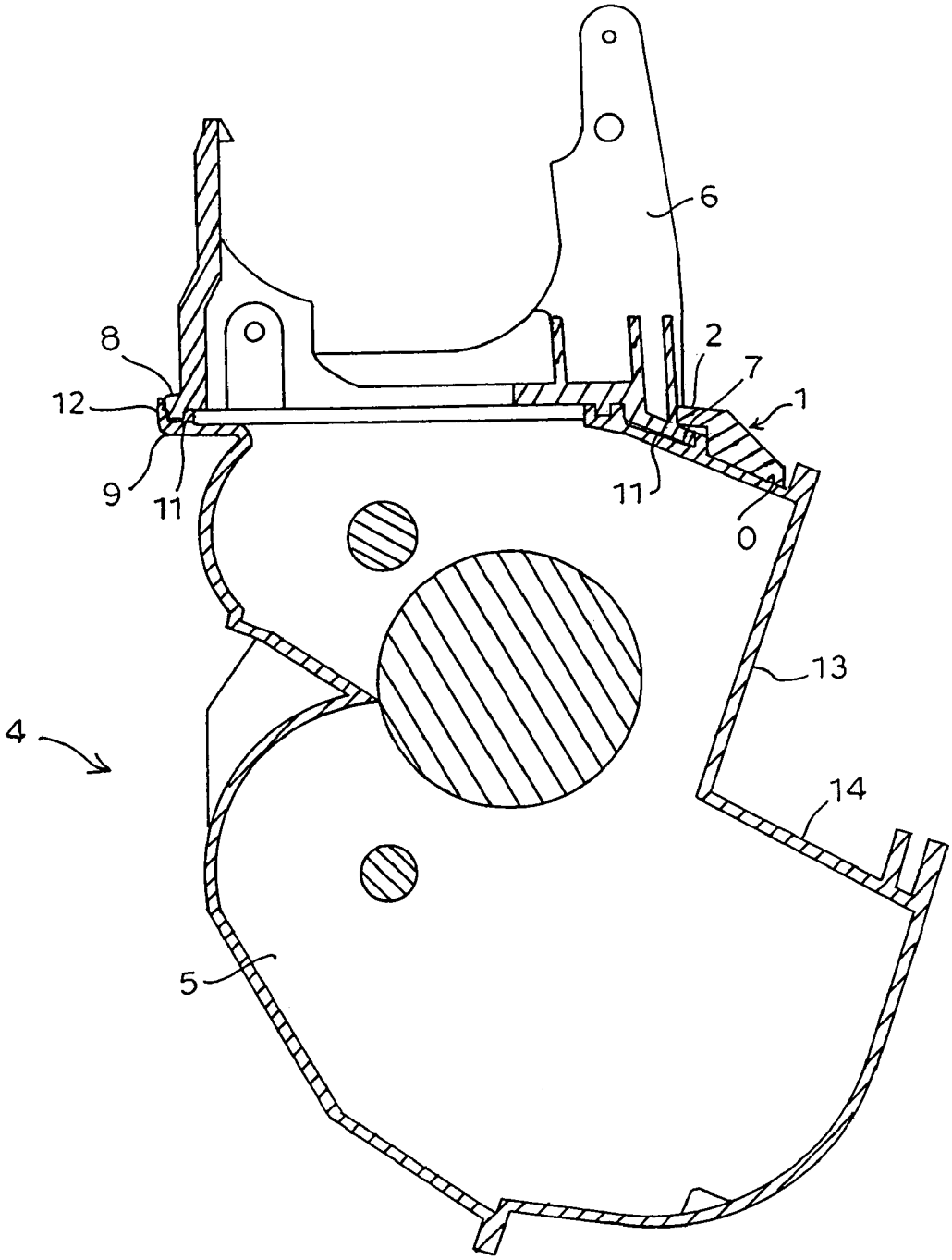
FIG. 3B is a cross sectional view of the HP4200 Toner Cartridge with securing fixture attached.

FIG. 3A shows the same HP4200 toner hopper assembly 4 as illustrated in FIG. 2A except that it has a securing fixture 1 attached. FIG. 3B shows cross sectional view of an HP4200 toner hopper assembly with the securing fixture 1 attached. The lip 2 can be seen to protrude roughly parallel to the bottom of the securing fixture 1. In this figure, the width of the securing fixture 1 can be seen conforming to the dimensions of the upper horizontal mounting surface 10. It is between the bottom of the securing fixture and the upper horizontal mounting surface 10 that some type of affixing agent would be applied. Also from this figure it can be seen that the forward securing edge 7 of the developer roller housing 6 tucks under the lip of the securing fixture 1. Another type of securing fixture could be made such that it could be attached to both the vertical mounting surface 13 as well as the upper horizontal mounting surface 10.

Figure 4:
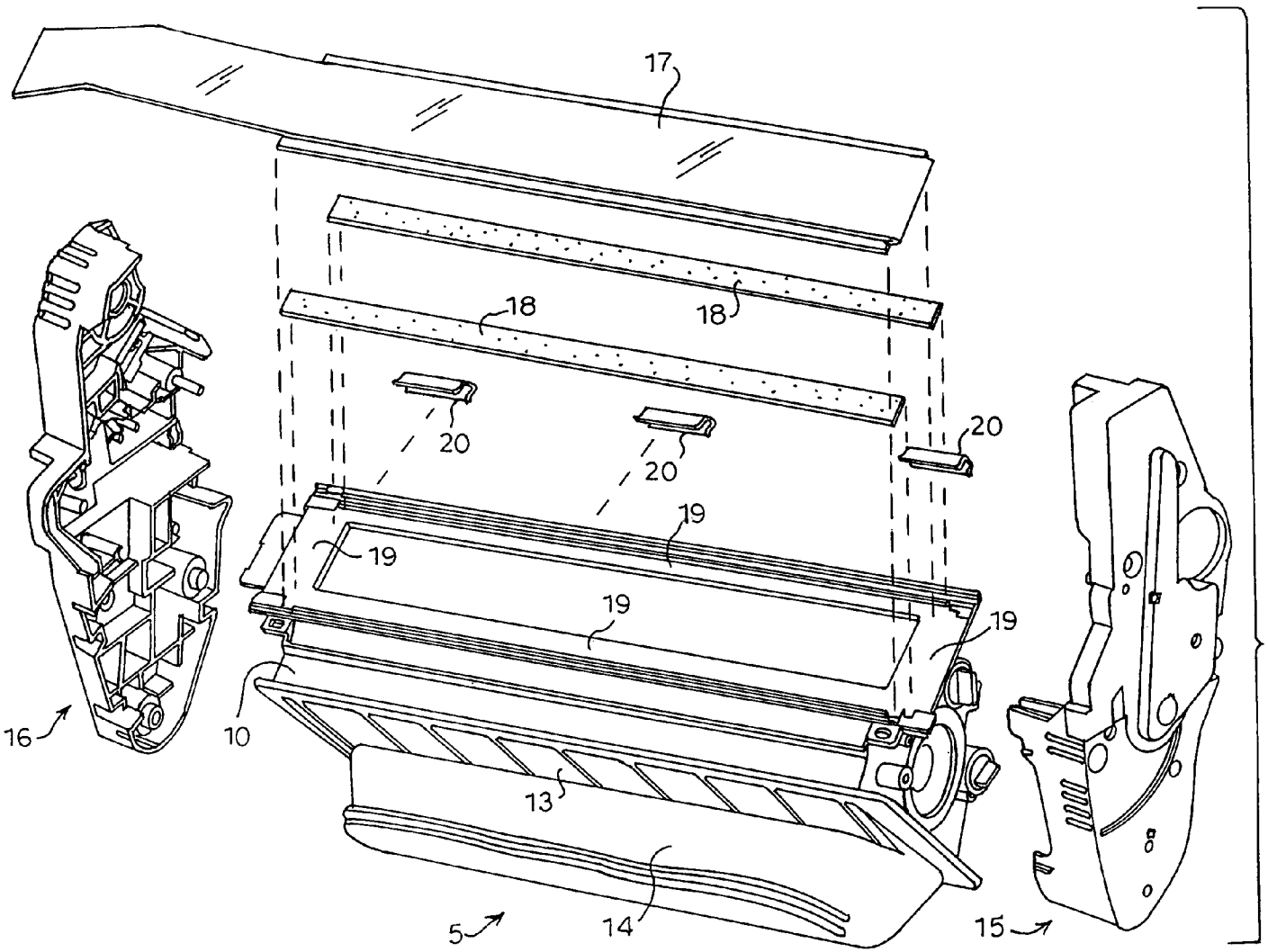
PRIOR ART FIG. 4
FIG. 4 is a front perspective view of the toner hopper reservoir (Prior Art).

When separating the toner hopper assembly 4 into its various subcomponents, different methods and tools may be employed. FIG. 4 illustrates the major components of the toner hopper reservoir 5. On each end of the toner hopper assembly are two endplates, a drive side endplate 15 and a contact side endplate 16. There are several screws holding both endplates in place. Once these screws are removed, the drive side endplate 15 will easily become detached. However on the contact side endplate 16, there are three additional polystyrene welds holding the contact side endplate 16 to the toner hopper assembly 4. Once weakened, these welds can be broken using a flat head screwdriver.

After removal of the endplates 15 & 16, the toner hopper reservoir 5 and the developer roller housing 6 will need to be separated. As discussed previously, this can be accomplished in several ways such as a wedge, a blade or mechanical saw. In cartridges that have both a front and rear combined flange, a unique tool may be employed to remove this ultrasonic weld. This tool is unique in that it may be adjusted to fit various types of cartridges, which may have different sizes and shapes. The blades are very thin so that the weld is the only part being removed. If the blades were too thick, too much material of the toner hopper reservoir 5 or developer roller housing 6 would also be removed.

Figure 5:
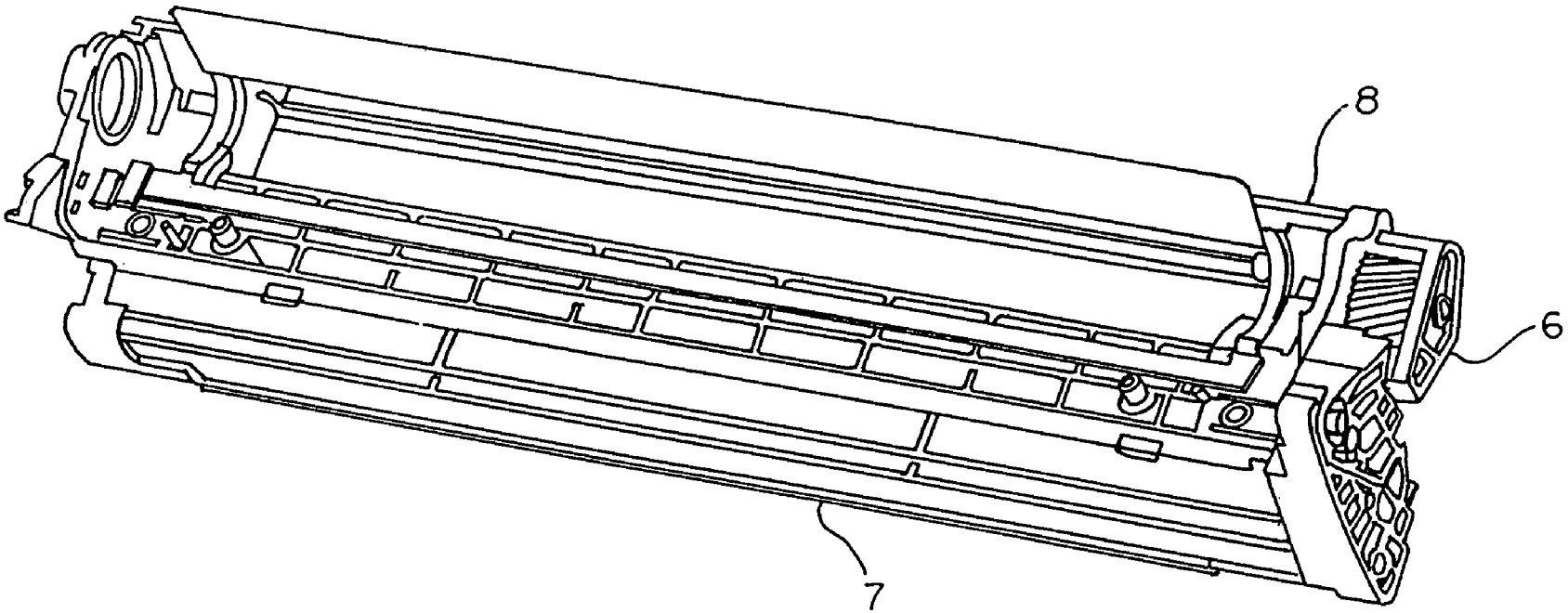
PRIOR ART FIG. 5
FIG. 5 is a front perspective view of the developer roller housing (Prior Art).

The main components of the developer roller housing 6 are shown in FIG. 5. From this illustration, the forward securing edge 7 is clearly visible. As well, at the rear of the developer roller housing 6, is the upper rear-securing flange.

An example of the items in the toner cartridge that might need to be replaced may include the OPC drum, PCR, gears, encoder wheels, and wiper blades just to name a few. As well, toner from the waste bin assembly and any remaining toner left over in the toner hopper reservoir 5 will need to be removed. New toner may be added once the cartridge is sufficiently cleaned. There will be various cleaning, prepping and refurbishing procedures that will all be performed in sequence as the cartridge is reconditioned.

The various pieces that will be reassembled on the toner hopper reservoir 5 are illustrated in FIG. 4. A sealing unit 17 will be placed on the toner hopper reservoir 5 at a horizontal sealing surface 19. This sealing unit 17 will keep the toner in the toner hopper reservoir 5 until the cartridge is ready for use. Once the cartridge is delivered to a customer, the customer removes this sealing unit and toner will be allowed to flow up into the developer roller housing 6. In addition, the horizontal foam units 18 will also be placed on the horizontal mounting surface 19. When the developer roller housing 6 is place on top of these horizontal foam units 18, they will become compressed and will want to expand. Thus these horizontal foam units 18 which provide the force that is exerted on the forward securing edge 7 and applied to the securing fixture 1, keep the developer roller housing in alignment and stationary.

When the developer roller housing 6 is mated to the toner hopper reservoir 5, a combined rear flange will be created on the rear portion of the two pieces. This combined rear securing flange 12 will protrude outward slightly. This protrusion will allow clips 20 to be used to secure the rear portion of the toner hopper assembly 4. One lateral edge of the clip 20 will be touching the upper rear flange 8 of the developer roller housing 6 and the other lateral edge will be in contact with the lower rear flange of the toner hopper reservoir 5. The clamping action of the clip will keep the rear portion secure and in proper alignment. The number of clips used as well as the size and clamping efficiency of the clips may vary depending on the size and shape of the rear combined flange. The main concern for the clips will be the ability to hold the two rear areas together but still be removable for later recycling procedures. Instead of these clips, an alternative manner of attaching these two flanges together may be used such as glue or ultrasonic welding. Gluing the two pieces together would limit the ease of later recycling and ultrasonic welding may prove to be cost ineffective.

Figure 6A:
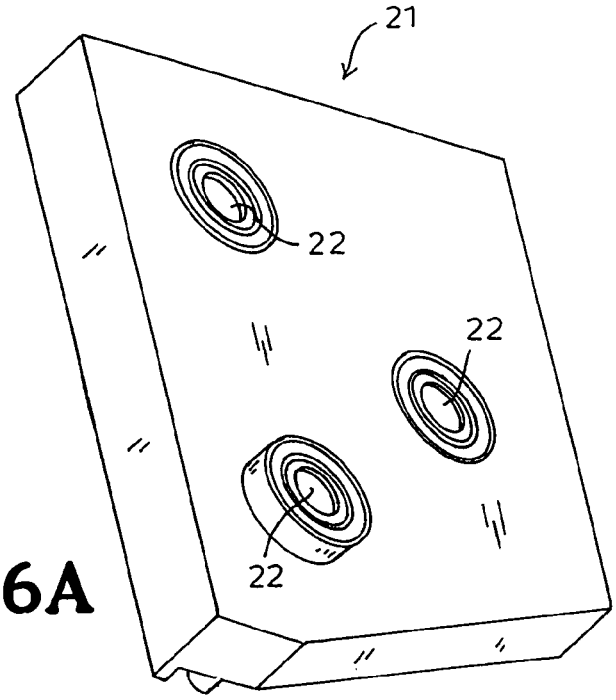
FIG. 6A is a top perspective view of a cleaning template.
Figure 6B:
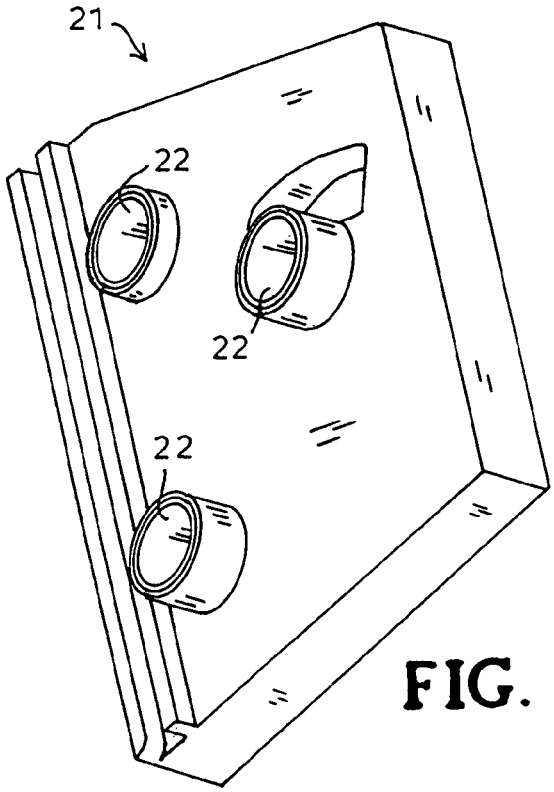
FIG. 6B is a bottom perspective view of a cleaning template.
Figure 7:
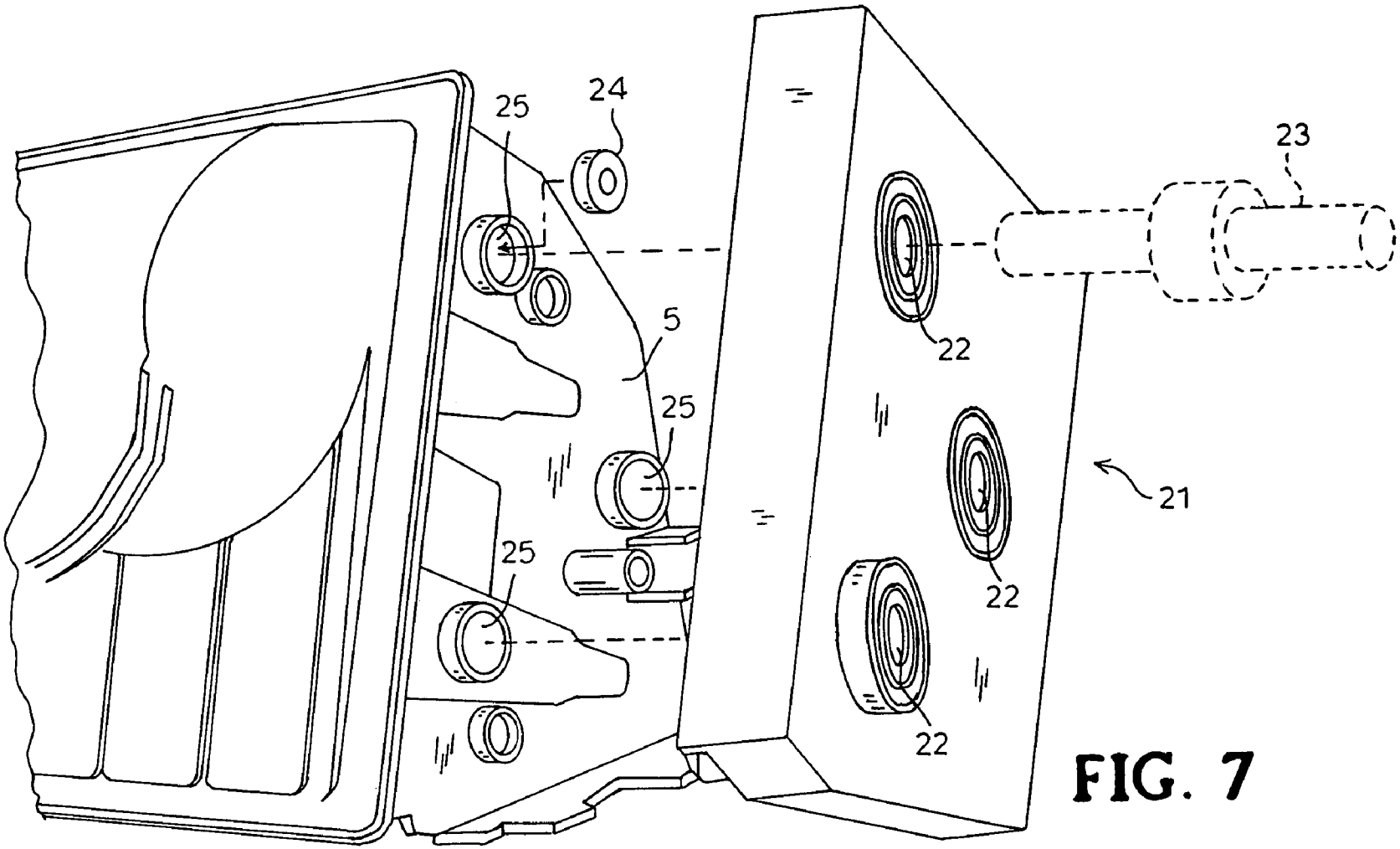
FIG. 7 is a side perspective view of a cleaning template being mounted on a toner hopper reservoir.

Another step required before final assembly will be the preparing of the toner hopper reservoir 5 for the fastening of the contact side endplate 16, as shown in FIG. 4. When the contact side endplate 16 is initially separated from the toner hopper assembly 4, the rivet like structure will need to be cleaned out of the toner hopper reservoir 5 so that a securing anchor 24 (FIG. 7) may be affixed in this location. In order to do this more efficiently, a cleaning template 21 has been created to help uniformly guide a cleaning instrument. The cleaning template 21, shown in FIGS. 6A and 6B will have three holes 22 which line up to the three positions that need to be cleaned. In the preferred embodiment, a set depth drill bit 23 will be utilized to remove this excess material, as shown in FIG. 7. The cleaning template 21 will be placed on top of the toner hopper reservoir 5 and held in place while a drill employing the set depth drill bit 23 will be inserted into the three holes 22. Once this material has been removed, an anchoring fixture 24 will be inserted and affixed to the orifice 25 and held in place using a permanent type of glue. The contact side endplate 16 will then be able to be secured to the toner hopper reservoir 5 by using a screw, which will pass through the contact side endplate 16 and secure itself into the anchoring fixture 24. The advantage of using this cleaning template 21 along with the set depth drill bit 23 is that the removal of excess material will always be uniform as well as the risk of compromising the toner hopper reservoir 5 will be diminished.

Where the anchoring fixture will attach will depend on the type of anchoring fixture being used as well as the type of toner cartridge the anchor fixture is being installed in. A mating means for attaching the anchor to this orifice or any other mounting area will be described in further detail of this specification. In addition, for the HP 4200 or HP 4300 cartridge types, the endplate that will be secured is located on the contact side of the toner cartridge assembly. In other cartridges the endplate may be located on the drive side or not have contacts at all. The present invention is intended for use in all replaceable consumable units that have an endplate.

For the HP 4200 or HP 4300 toner cartridge, the orifices 25 will have an internal wall and an external wall as well as a floor. In the HP 4200 or HP 4300 the orifice is preferably cleaned using the template described above. In an alternative embodiment, these orifices may not need cleaning or boring. As will be described in detail, certain anchoring fixtures will attach to the internal wall of the orifice 25. Others will attach to the external wall and others will attach to the floor.

The anchoring fixture 24 may be made out of various types of materials; for example, plastic or metal may be used. If an anchoring fixture 24 were to be installed in the orifice 25, it could be held in place by glue or other types of adhesive. Glue would be applied to the bottom of the orifices 25 and the anchoring fixture would then be placed on top of the glue. Alternatively, the anchoring fixture could be sealed so that the friction between it and the orifice 25 would hold the two together. The anchoring fixture may also be attached upon insertion to the orifice 25 on the toner hopper reservoir 5 by ribs as more fully described below. FIGS. 8A, 8B, 8C, 8D, 8E and 8F are all illustrations of alternative embodiments of the anchoring fixture 24.

Figure 8A:
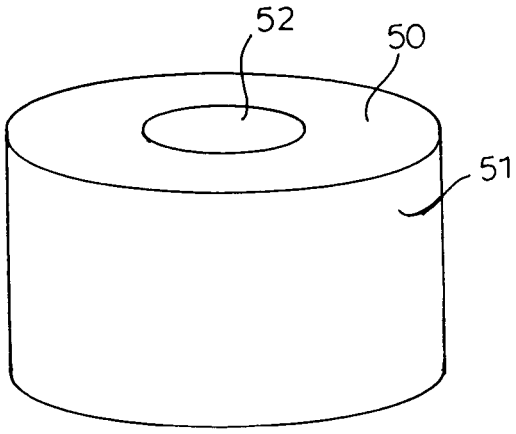
FIG. 8A is a perspective view of a cylindrical anchoring fixture.

FIG. 8A is the most simplistic example of an anchoring fixture. In FIG. 8A, the anchoring fixture 24 would have a top surface 50, a supporting wall 51 and a securing fixture orifice 52. In this example, the supporting wall would be one continuous wall since the anchoring fixture 24 is cylindrical in shape. In the preferred embodiment, this type of anchoring fixture 24 would be plastic and would be attached inside the orifice 25 with glue or other types of adhesive. If the diameter of the anchoring fixture were smaller than the diameter of the inside of the orifice, glue might also be applied to the internal wall as well as the bottom. However, if the diameters are significantly different, an alignment issue may arise due to the positioning of the securing fixture orifice 52 within the orifice 25. Once the anchoring fixture is installed, the endplate will be reattached using some type of securing device. In the preferred embodiment, the securing device will be a screw which attaches to the anchoring fixture 24 at the securing fixture orifice 52. Instead of a screw however, a rivet or other mechanism may be employed to keep the endplate secured to the anchoring fixture 24 at the securing fixture orifice 52. In an alternative embodiment the top surface 50 would not have a securing fixture orifice 52. If the top surface 50 were made of a sufficiently soft plastic or metal than a self-tapping screw could be used to pierce the top surface 50 securing the contact side endplate 16 to the toner cartridge assembly.

Figure 8B:
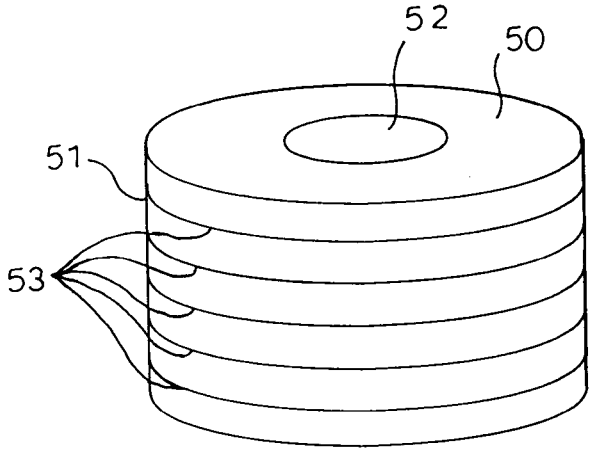
FIG. 8B is a perspective view of a cylindrical anchoring fixture with contact ribs.

An alternative embodiment of the anchoring fixture 24 is shown in FIG. 8B. In this embodiment the anchoring fixture 24 has contact ribs 53 on the supporting wall 51. In this embodiment, the contact ribs compress upon installation thus mating with the orifice 25.

Figure 8C:
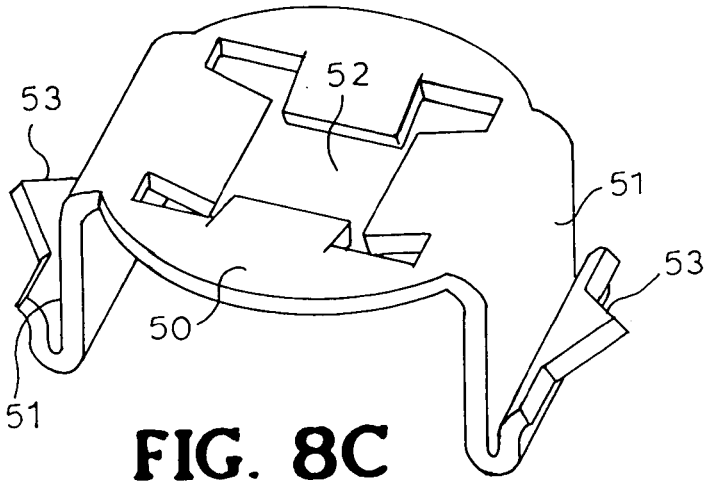
FIG. 8C is a perspective view of a non-cylindrical anchoring fixture with one contact rib.
Figure 8D:
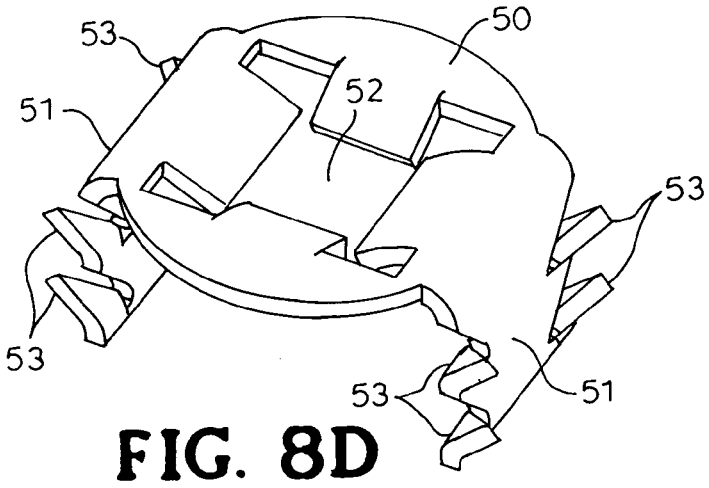
FIG. 8D is a perspective view of a non-cylindrical anchoring fixture with multiple contact ribs.

FIG. 8C is an illustration of a non-cylindrical shaped anchoring fixture. This anchoring fixture has two supporting walls 51 below the top surface 50 as well as the anchor fixture orifice 52. Additionally, this anchor fixture has contact ribs 53 that protrude out from the center of the anchoring fixture, which will make contact with the internal wall of the orifice 25 of the toner hopper reservoir 5. These contact ribs 53 will engage the internal wall of the orifice 25 when the anchoring fixture 24 is inserted inside the orifice 25. FIG. 8D is an example of an alternative embodiment of the present invention except that this anchoring fixture 24 has multiple contact ribs 53 on each supporting wall 51. In the embodiment depicted in FIGS. 8C and 8D the contact ribs 53 are barbed to ensure a secure mating of the anchoring fixture 24 and the orifice 25.

Figure 8E:
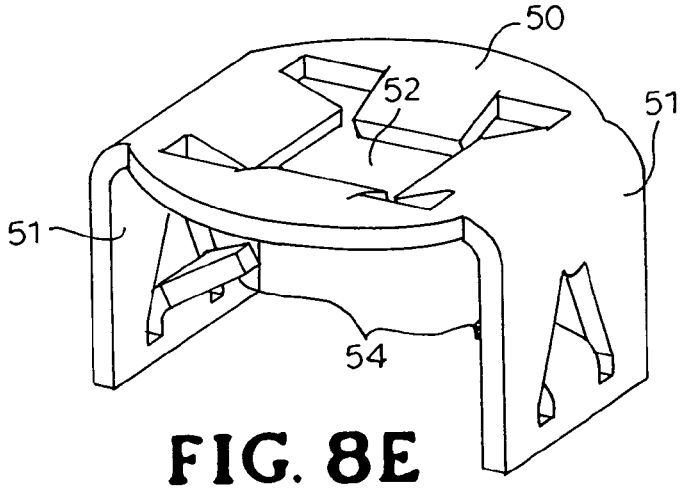
FIG. 8E is a perspective view of a non-cylindrical anchoring external wall attaching anchoring fixture.

FIG. 8E shows another preferred embodiment of the present invention. The anchoring fixture shown in FIG. 8E has external wall contact ribs 54, which protrude towards the center of the anchoring fixture 24 from the supporting wall 51. This anchoring fixture would slip around the outside of the orifices 25 and attach itself to the external wall of the orifice 25. The diameter of this anchoring fixture would be greater than the diameter of the orifice. An advantage to this particular embodiment is that the orifices 25 may not need to be bored out in order for the anchoring fixture 24 to function.

Figure 8F:
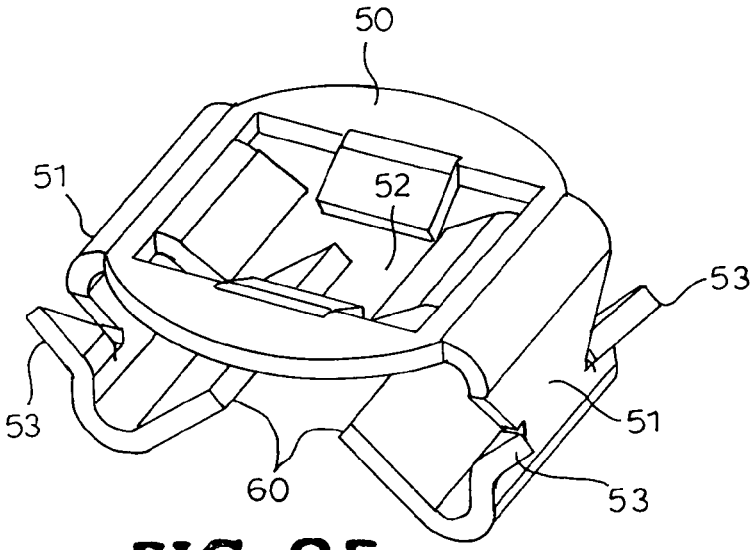
FIG. 8F is a perspective view of a non-cylindrical anchoring fixture with screw activated multiple contact ribs.

Another preferred embodiment is illustrated in FIG. 8F. Here internal screw contact ribs 60 would work in conjunction to the contact ribs 53. When the screw is inserted into the securing fixture orifice 52, and starts to engage the screw contact ribs 60, the contact ribs 53 will begin to move outward from the center of the anchoring fixture 24 engaging with the orifice 25 securing the anchoring fixture 24. Once the screw is fully inserted into the anchoring fixture 24, the contact ribs 53 are embedded into the side of the orifice internal wall, and will securely hold the anchoring fixture 24 in place.

In all the previous examples, the anchoring fixture 24 has been attached to an orifice already existing on the toner cartridge. The anchoring fixture 24 need not be attached to an orifice. Instead it may simply attach to a surface of the toner cartridge. The main requirement would be that there be enough surface area for the anchoring fixture 24 to mount.

Although this invention has been described with respect to the specific embodiments herein, it should be understood that the invention is not limited to these embodiments, they may take other shapes and forms to accommodate the particular toner cartridges at issue. Other variations and departures from the specific embodiment disclosed herein may also be used without departing from the spirit of this invention.

What is claimed is:

1. A method for remanufacturing a toner cartridge comprising:

providing the toner cartridge comprising an end plate secured to an end of the toner cartridge;

removing the end plate from the toner cartridge;

attaching an anchoring fixture to the end of the toner cartridge; and securing the end plate to the anchoring fixture of the toner cartridge.

2. The method of claim 1 wherein securing the end plate to the anchoring fixture comprises:

attaching a securing device to the anchoring fixture, the securing device holding the end plate adjacent the end of the toner cartridge.

3. The method of claim 2 wherein the securing device extends through a hole in the end plate and attaches to the anchoring fixture.

4. The method of claim 1 further comprising:

forming a mounting area on the end of the toner cartridge; and attaching the anchoring fixture to the mounting area.

5. The method of claim 4 wherein the mounting area comprises an orifice.

6. The method of claim 5 wherein attaching the anchoring fixture to the mounting area comprises:

attaching the anchoring fixture to at least a wall of the orifice.

* * * * *